US006017872A

United States Patent [19]

Pedersen et al.

[11] Patent Number: 6,017,872

[45] Date of Patent: Jan. 25, 2000

[54] COMPOSITIONS AND PROCESS FOR CLEANING AND FINISHING HARD SURFACES

[75] Inventors: Daniel E. Pedersen, Cottage Grove; Keith G. LaScotte, Maplewood, both of Minn.

[73] Assignee: Ecolab Inc., St. Paul, Minn.

[21] Appl. No.: 09/093,321

[22] Filed: Jun. 8, 1998

[51] Int. Cl.[7] ..... C11D 17/00

[52] U.S. Cl. ..... 510/424; 510/201; 510/214; 510/428

[58] Field of Search ..... 510/201, 214, 510/424, 428

[56] References Cited

U.S. PATENT DOCUMENTS

| | | | |
|---|---|---|---|
| 3,579,540 | 5/1971 | Ohlhausen | 260/33.4 |
| 3,855,085 | 12/1974 | Rushmere | 204/55 |
| 4,587,030 | 5/1986 | Casey | 252/92 |
| 5,106,416 | 4/1992 | Moffatt et al. | 106/20 |
| 5,183,502 | 2/1993 | Meichsner et al. | 106/22 |
| 5,417,893 | 5/1995 | Ofosu-Asante | 252/558 |
| 5,536,452 | 7/1996 | Black | 252/238 |
| 5,587,022 | 12/1996 | Black | 134/26 |
| 5,589,099 | 12/1996 | Baum | 510/514 |
| 5,599,400 | 2/1997 | Mao et al. | 134/25.2 |
| 5,599,586 | 2/1997 | Israel | 422/299 |
| 5,698,087 | 12/1997 | Bokisa | 205/254 |
| 5,738,944 | 4/1998 | Fromson et al. | 428/409 |

FOREIGN PATENT DOCUMENTS

WO 98/02511 1/1998 WIPO .

*Primary Examiner*—Necholus Ogden
*Attorney, Agent, or Firm*—Merchant & Gould P.C.

[57] ABSTRACT

Hard surfaces such as tile, metal, glass, etc. typically in hospitality locations can be cleaned to a bright, shiny, residue-free appearance using a process comprising cleaning the surface with a first cleaning composition and removing the resulting cleaner residue with a finish cleaner composition. The finish cleaner composition removes all trace of soil and cleaner from the first step and dries to a bright, shiny, spot-free, streak-free, and film-free appearance without a need for a final wipe step.

19 Claims, No Drawings

COMPOSITIONS AND PROCESS FOR CLEANING AND FINISHING HARD SURFACES

FIELD OF THE INVENTION

The invention relates to finish cleaner compositions for hard surfaces. A finsh cleaner composition is a composition that can be applied to a hard surface for the purpose of obtaining a clean, shiny, residue-free surface without post-cleaning, scrubbing or wiping by the operator. The compositions of the invention can be applied to remove soil and then dry to a clean, bright, shiny appeaace. The finish cleaner can be used alone or with other compositions. In a preferred mode the finish cleaner is applied after a first cleaner is used and removes all cleaner residue and residual soil leaving a clean shiny surface with no need to wipe or polish the surface.

BACKGROUND OF THE INVENTION

In the institutional, industrial and hospitality industries, cleaning of hard surfaces such as metal, painted metal, glass and tile is a labor intensive activity. Such surfaces commonly appear in kitchens, bathrooms, food preparation and manufacturing locations, fast food restaurants, cars, etc. Commonly, in cleaning such surfaces the maintenance personnel apply an aqueous cleaner composition to the surface either in a foamed or non-foamed aqueous composition. Soil is then mechanically contacted with scrub brushes, cleaning towels and other cleaning implements. The soil and the cleaning material is rinsed and the remaining rinse water is often removed by wiping, squeegee, or other processes in which the maintenance personnel remove remaining water spots. The last wiping/squeegee step is important to ensure that the hard surface dries to a shiny, bright, spot-free, streak-free and film-free appearance.

In installations having many hard surfaces requiring periodic cleaning on a daily, weekly, etc. basis, the investment in labor, energy and cost is significant. Any reduction in the time, energy and materials used in hard surface maintenance will substantially improve productivity and reduce costs. One important step in hard surface maintenance is the final wiping or squeegeeing of hard surfaces to remove the aqueous rinse. Such operations can consume a substantial proportion, typically between 10 and 30%, of the time involved in hard surface maintenance in most institutional, industrial, hospitality locations. Elimination of the final squeegee/wipe step can obviously save substantial time, effort and money. In typical hard surface maintenance, the final wiping/squeegeeing step is required. No cleaner currently available provides for a simple spray application which dries to a bright, clear, shiny surface without spotting, streaking or film development. A substantial need exists for such a finish cleaner that can be used alone or with other cleaners to remove soil from hard surfaces leaving a shiny, spot-, streak- and film-free appearance.

In the prior art, attempts have been made to use modified silicones, hydrophobic mineral oils and other hydrophobic means to increase the tendency of aqueous materials to drain from a clean surface. We have found that the hydrophobic materials surprisingly increase surface energy and retain water as droplets of various sizes, rather than causing the water to sheet or drain freely. In using such hydrophobic materials, cleaning stations such as car washes tend to use forced air to coalesce and remove droplets or to remove water using chamois, squeegee or towel. Black, U.S. Pat. Nos. 5,536,452 and 5,587,022 teach a spray-on material used after showering that is formulated to maintain shower appearance. Such materials do not operate as a finish cleaner composition and simply are formulated to reduce the accumulation of new soil on a shower location. The compositions contain a specific surfactant and volatile cleaner materials to promote drying.

Accordingly, a substantial need exists for improved cleaning compositions and in particular for a finish cleaner composition that can be used after an initial cleaning step which can, after a spray on application, dry to a clean, bright, shiny appearance with no spotting, streaking or film residue. Such a cleaner can save significant time and money and can improve the appearance of hospitality locations.

BRIEF DISCUSSION OF THE INVENTION

The finish cleaner compositions of the invention have application to cleaning processes using both acid and alkaline cleaners containing an aromatic sulfonate, a sulfosuccinate and a defoaming nonionic. Such cleaners have a pH value that ranges from about 1.5 to about 11. The cleaner compositions can contain acid or basic components, anionic or nonionic surfactants, chelating agents, water hardness modifiers, organic or inorganic builders, fragrances, surfactants, dyes, solvents and other conventional ingredients. Cationics are not compatible with these cleaners. Under certain circumstances for particular end uses, threshold agents or antimicrobial agents can be incorporated into the rinse product if needed. In developing the compositions of the invention, we have found that common rinse aid or sheeting materials used in warewashing do not provide adequate sheeting at room temperature on common hospitality hard surface at economical use levels. The combination of the ester sulfonate and the aromatic sulfonate of the invention at surprisingly low concentration obtained excellent finish cleaning and dry down performance. The addition of specific low foam defoaming surfactants result in the creation of a foamed composition with the finish cleaners of the invention which produces no foam or a weak foam that rapidly breaks down to a material that sheets and drains from the surface rapidly leaving a clean appearance. Surprisingly, the finish cleaner compositions of the invention rapidly remove even the most heavy duty formulations containing high concentrations of active materials and associated soil residues from hard surfaces leaving no cleaner or soil residue on a shiny, spot- and streak-free surface. In contrast, current cleaning compositions, while effective in soil removal, can often leave unsightly spot, streak or film residue on hard surfaces even after a significant effort in removing the soil in a cleaning regiment.

We have also found a unique cleaning process that can produce a clean, bright, shiny hard surface free of spots, streaks or film resulting from a regiment containing at least two process steps. In the first process step, a hard surface cleaner is applied to a soiled surface to loosen and substantially remove soil residue from the surface. The first hard surface cleaner is followed by a finish cleaner that can be applied to the surface and can remove all soil and cleaner residue leaving a clean, bright, shiny, spot-free, streak-free and film-free surface. The finish cleaner can be used in a single step to clean surfaces with minimal to moderate soil. The finish cleaner combines a unique combination of surfactants in an aqueous base with solvents in an optimized formula that can be sprayed on to a hard surface and can leave a clean surface without the investment of significant amount of effort in wiping the surface following the finish cleaner application. Avoiding the labor intensive hard surface wiping step represents a significant savings in time and money.

The finish cleaner compositions of the invention comprise an aqueous base cleaner comprising a sulfonate ester surfactant of the formula:

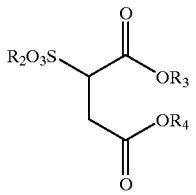

wherein each $OR_3$ or $OR_4$ comprises a $C_{1-20}$, preferably a $C_{1-12}$ aliphatic group and $R_2$ is $H^+$, an alkali metal cation, $NH_4^+$, or a mono-, di- or triethanol amine cation. The cleaner also can contain a second aromatic sulfonate surfactant comprising a variety of aromatic sulfonate surfactant materials. Preferred aromatic sulfonate surfactants including alkyl benzene sulfonates, alkylnapthene sulfonates, dialkyl benzene sulfonates such as xylene sulfonate, petroleum sulfonates made by sulfonating highly aromatic feed stocks and other sulfonates with ester amide or ether linkages. One particularly preferred sulfonate in the invention comprises an alkyl diphenyl oxide disulfonated material. Such materials are made by sulfonating an alkyl diphenyl oxide material. The final sulfonate product comprises a sulfonate material that contain mono- and disulfonated species. The preferred sulfonate material generally corresponds to a composition generally described by the formula:

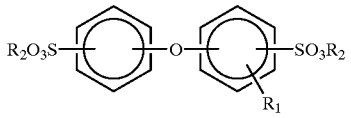

wherein $R_1$ is a $C_{1-12}$ aliphatic group and each $R_2$ can independently be $H^+$, an alkali ametal cation, $NH_4^+$, or a mono-, di- or triethanol amine cation. These surfactants cooperate to ensure that the soil and cleaner residue remaining on the hard surfaces is effectively removed. This surfactant blend is combined with a defoaming nonionic surfactant which promotes the ready sheeting removal of the finish cleaner composition. The aqueous finish cleaner composition additionally comprises a water soluble solvent material that aids in soil removal and promotes drying of the surfaces due to the volatile nature of the solvent material. Preferred solvents comprise mono-, di- and triethylene glycol, mono- and dialkyl ethers and alkanols. The invention also contemplates concentrate materials comprising a dilutable composition containing appropriate amounts of each component in the form of a material that can be added to water to form a highly effective aqueous finish cleaning composition of the invention.

The finish cleaner composition of the invention is typically sprayed onto either a moderately soiled surface or a hard surface that has already been contacted with an aqueous cleaner composition. The spray-on process step typically forms a film or foam comprising the finish cleaner material. The foam rapidly breaks down to form a continuous wet sheet which drains rapidly from the surface and dries even on cool surfaces. At temperatures common in hospitality locations, mirror surfaces, stool, tub and sink surfaces tend to be cool and damp and often resist sheeting. We have found that the unique formulation of the finish cleaner of the invention provides sheeting action sufficient to leave a spotless shiny surface. Initial moderate to low foam is an important property of the finish cleaner of the invention to provide removal of the initial hard surface cleaner and to ensure complete foam collapse for sheeting to occur. We have found that the finish cleaner of the invention is useful on hard hospitality surfaces but can also be used on glass, rubber, metal, painted metal, etc. on other surfaces such as automobiles, etc. Any hard surface such as glazed tile, gel coated fiberglass, chrome, glass, marble, porcelain, painted metal, etc. can be cleaned with the finish cleaner of the invention.

DETAILED DISCUSSION OF THE INVENTION

The finish cleaners of the invention can be used in a process for cleaning hard surfaces in which a first cleaner can be applied to the hard surface to remove gross soils and the finish cleaner can be applied to remove any soil residue and any cleaner residue. After application, the finish cleaner drains from the surface leaving a clean surface free of spots, streaks or films of soil or cleaner components. Aqueous cleaners for hard surfaces have been available for many years in both household and institutional cleaning locations and are exemplified below. Such cleaners have developed the ability to remove organic and inorganic soils including food residue, soap scum, grease, hardness components, hair, residue from toiletry articles and the like from hard surfaces. Both neutral, acidic and basic aqueous materials have been used, depending on the use locus and the soil type. Commonly, such cleaners comprise a major proportion of the solvent such as water or mixed aqueous/organic solvent and components such as chelating agents such as EDTA, NTA and others, anionic, nonionic and cationic surfactants, disinfectants, fragrances, dyes, solvents, foaming agents, etc. These cleaners have been known to perform adequately on many soils, however, in certain applications and with certain soils, use of these cleaners can require an extensive rinsing and wiping step to ensure no visible residue remains on any hard surface after use. Such residues can arise from remaining soil, residual cleaner material, hardness components or any other material common in the environment. In the absence of a final rinse and wipe, the hard surfaces can be left with spots, streaks or film that can be unsightly and require cleaning.

In today's management of hospitality locations including hotels, cruise ships, hospitals, and other locations housing large numbers of individuals with bathroom facilities containing mirrors, stools, tubs, vanities, sinks and other convenience items, the cleaning and maintenance of such installations is time consuming and expensive. Hospitality management has learned that cleaning comfort facilities in the hospitality location is a major cost and represents a major investment of maintenance effort. Any composition or product that reduces costs and saves time in maintenance of such hospitality facilities can be a significant cost savings and increase the attractiveness and comfort of the hospitality location.

The finish cleaner compositions of the invention can be formulated with an aromatic sulfonate surfactant or a preferred alkyl-diphenyl oxide disulfonate of the formula:

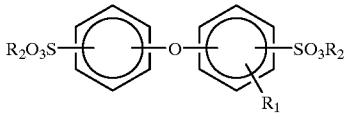

wherein $R_1$ is a $C_{1-12}$ aliphatic group and each $R_2$ can independently be $H^+$, an alkali metal cation, $NH_4^+$, or a mono-, di- or triethanol amine cation. The sulfonic acid moieties of the molecule formula above show a disulfonic acid structure. The commercial products relating to such a material comprise a complex mixture of mono- and disulfonates, mono- and dialkylates, and alkali metal sulfonate salts thereof. Accordingly, the formula above is a general guide to the use of such aromatic monodisulfonate materials. Suitable commercially available aromatic sulfonate surfactants include the DOWFAX® series from Dow Chemical and the POLYTERGENT® series from Olin Corporation.

The finish cleaner composition can also contain an ester sulfonate surfactant of the formula:

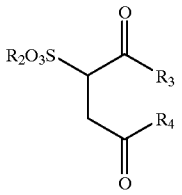

wherein each $R_3$ and $R_4$ is independently a $C_{1-12}$, preferably a $C_{1-14}$ aliphatic group and $R_2$ is $H^+$, an alkali metal cation, $NH_4^+$ or a mono-, di-, or triethanol amine cation. Such materials are typically called dialkyl sulfosuccinate ester surfactants.

The finish cleaner compositions of the invention can also contain a nonionic surfactant that can modify the foaming properties of the material to result in a spray-on material that develops low foaming properties. The low foam generated upon application rapidly collapses to leave a sheet that is removed from the surface by the action of gravity and rapid drying. The resulting surface is left shiny, spot-, streak- and film-free. For proper activity, the finish cleaners of the invention comprise a nonionic defoaming surfactant that permits the formation of a foam that is weak and rapidly collapses leaving an aqueous composition that is rapidly removed from the surface by the action of gravity. Such nonionic surfactants are common. One preferred nonionic surfactant comprises nonionic polyoxyethylene substituted acetylene glycol surfactants. Such compounds of this type are described in U.S. Pat. No. 3,855,085. Such polyoxyethylene compounds are available commercially under general trade designation SURFYNOL® by Air Products and Chemicals Incorporated. Examples of specific polyoxyethylene acetylene glycol surfactants include molecules containing 1 to 20 moles of ethylene oxide reacted with 1 mole of a acetylene diol such as a tetramethyldecynediol. SURFYNOL® 485 is the product obtained by reacting 30 moles of ethylene oxide with a tetramethyldecynediol. Other examples of acetylene glycol surfactants include 2,4,7,9-tetramethyl-5-decyne-4,7-diol, 3,6-dimethyl-4-octyne-3,6-diol and 3,5-dimethyl-1-hexyne3-diol. Examples of such materials include SURFYNOL® 104, 82, 465, 485, and TG. The amount of acetylene glycol surfactant used in the compositions of the invention generally vary from about 0.1 to about 10 wt % or preferably about 0.5 to 5 wt % depending on the level of foam desired. A preferred surfactant comprises SURFYNOL® 504.

Further, nonionic surfactants include those available from BASF Wyandotte Corporation of Wyandotte, Michigan under the designation PLURONIC® and TETRONIC®. PLURONIC® surfactants have the formula:

$$(EO)_x(PO)_y(EO)_z;$$

wherein each EO comprises an ethylene oxide residue, each PO comprises a propylene oxide residue, each x is an integer of about 2 to about 128, each y is an integer of about 16 to about 67 and each z is an integer of about 16 to about 67. Useful surfactants have the general formula:

$$(PO)_x(EO)_y(PO)_z;$$

wherein each EO comprises an ethylene oxide residue, each PO comprises a propylene oxide residue, each x is an integer of about 7 to about 21, each y is an integer of about 4 to about 136 and each z is an integer of about 7 to about 21. Another class of usefwl surfactants have the general formula:

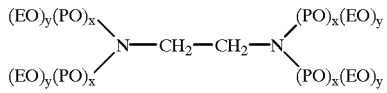

wherein each EO comprises an ethylene oxide residue, each PO comprises a propylene oxide residue, each x is an integer of about 4 to about 30 and each y is an integer of about 30 to about 122. Another class of usefull surfactants have the general formula:

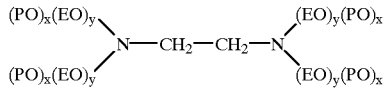

where each EO comprises an ethylene oxide residue, each PO comprises a propylene oxide residue, each x is an integer of about 8 to about 30 and each y is an integer of about 1 to about 124. The "R" designation refers to reverse nonionics. Such nonionic surfactants are formulated to be compatible with the aqueous formulation and to produce a rapidly collapsing foam.

The compositions of the invention also contain an aqueous soluble or miscible solvent material. Such solvents can include lower alkanols including methanol, ethanol, isopropanol, propanol, ethylene glycol, propylene glycol, ethylene glycol mono- and dialkyl ethers, propylene glycol, mono- and dialkyl ethers, diethylene glycol, mono- and dialkyl ethers, etc. The solvents can comprise compounds of the formulae:

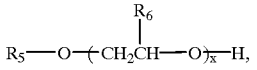

$R_8OH$ and mixture thereof.

wherein $R_5$ and $R_8$ are independently H or a $C_{1-8}$ linear or branched aliphatic group, preferably alkyl groups, $R_6$ is either H or $CH_3$ and x comprises an integer of about 2 to 5. Representative examples of useful solvents include methanol, ethanol, isopropanol, ethylene glycol, monomethylether, ethylene glycol monobutylether, 2-phenoxyethanol, ethoxy ethyl acetate, 2-ethoxyethanol, ethylene glycol monoethylether and other known water soluble or miscible solvents. Such solvents aid in soil removal, foam control and promote drying after sheeting has occurred.

We have found that sequestrants, chelates or water conditioning agents are useful in compositions and processes of the invention. Soil removal is enhanced by attaching $Ca^{2+}$ residues. Sequestrants function to inactivate water hardness and prevent calcium and magnesium ions from interacting with soils, surfactants, carbonate and hydroxide. Water conditioning agents therefore improve detergency and prevent long term effects such as insoluble soil redepositions, mineral scales and mixtures thereof. Water conditioning can be achieved by different mechanisms including sequestration, ion-exchange and dispersion (threshold effect).

The water conditioning agents which can be employed in the detergent compositions of the invention can be inorganic or organic in nature; and, water soluble or water insoluble at use dilution concentrations. These act to remove $Ca^{2+}$ and $Mg^{2+}$ from the soil/surface interface by a chelation or sequestering action.

Useful examples condensed polyphosphates such as tripolyphosphate, trimetaphosphate and ring open derivatives; and, glassy polymeric metaphosphates of general structure $M_{n+2}P_nO_{3n+1}$ having a degree of polymerization n of from about 6 to about 21 in anhydrous or hydrated forms; and mixtures thereof Organic water soluble water conditioning agents useful in the compositions of the present invention include aminopolyacetates, polyphosphonates, aminopolyphosphonates, short chain carboxylates and a wide variety of polycarboxylate compounds. Organic water conditioning agents can generally be added to the composition in acid form and neutralized in situ; but can also be added in the form of a pre-neutralized salt. When utilized in salt form, alkali metals such as sodium, potassium and lithiun; or, ammonia and substituted ammonium salts such as from mono-, di- or triethanolamine cations are generally preferred.

Polyphosphonates usefull herein specifically include the sodium, lithium and potassium salts of ethylene diphosphonic acid; sodium, lithium and potassium salts of ethane-1-hydroxy-1,1-diphosphonic acid and sodium lithium, potassium, ammonium and substituted ammonium salts of ethane-2-carboxy-1,1-diphosphonic acid, hydroxymethanediphosphonic acid, carbonyldiphosphonic acid, ethane-1-hydroxy-1,1,2-triphosphonic acid, ethane-2-hydroxy-1,1,2-triphosphonic acid, propane-1,1,3,3-tetraphosphonic acid, propane-1,1,2,3-tetraphophonic acid and propane 1,2,2,3-tetraphosphonic acid; and mixtures thereof. Examples of these polyphosphonic compounds are disclosed in British Pat. No. 1,026,366. For more examples see U.S. Pat. No. 3,213,030 to Diehl issued Oct. 19, 1965 and U.S. Pat. No. 2,599,807 to Bersworth issued Jun. 10, 1952. The water soluble amninopolyphosphonate compounds are excellent water conditioning agents and may be advantageously used in the present invention. Suitable examples include soluble salts, e.g. sodium, lithium or potassium salts, of diethylene thiamine pentamethylene phosphonic acid, ethylene diamine tetramethylene phosphonic acid, hexamethylenediamine tetramethylene phosphonic acid, and nitrilotrimethylene phosphonic acid; and, mixtures thereof.

Suitable water soluble polycarboxylate water conditioners for this invention include the various ether polycarboxylates, polyacetal, polycarboxylates, epoxy polycarboxylates, and aliphatic-, cycloalkane- and aromatic polycarboxylates. Water soluble polymeric aliphatic carboxylic acids and salts preferred for application are compositions of this invention are selected from the groups consisting of:

(a) water soluble salts of homopolymers of aliphatic polycarboxylic acids and salts thereof having the followin emical formula:

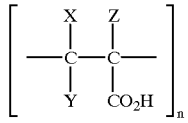

wherein X, Y, and Z are each selected from the group consisting of hydrogen methyl, carboxyl, and carboxymethyl, at least one of X, Y, and Z being selected from the group consisting of carboxyl and carboxymethyl, provided that X and Y can be carboxymethyl only when Z is selected from carboxyl and carboxymethyl, wherein only one of X, Y, and Z can be methyl, and wherein n is a whole integer having a value within a range, the lower limit of which is three and the upper limit of which is determined by the solubility characteristics in an aqueous system;

(b) water soluble salts of copolymers of at least two of the monomeric species having the empirical formula described in (a), and (c) water soluble salts of copolymers of a member selected from the group of alkylenes and monocarboxylic acids with the aliphatic polycarboxylic compounds described in (a), said copolymers having the general formula:

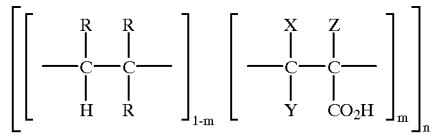

wherein R is selected from the group consisting of hydrogen, methyl, carboxyl, carboxymethyl, and carboxyethyl; wherein only one R can be methyl; wherein m represents at least 45 mole percent of the copolymer; wherein X, Y, and Z are each selected from the group consisting of hydrogen, methyl, carboxyl, and carboxymethyl; at least one of X, Y, and Z being selected from the group of carboxyl and carboxymethyl provided that X and Y can be carboxymethyl only when Z is selected from group of carboxyl and carboxymethyl, wherein only one of X, Y, and Z can be methyl and wherein n is a whole integer within a range, the lower limit of which is three and the upper limit of which is determined primarily by the solubility characteristics in an aqueous system; said polyelectrolyte builder material having a minimum molecular weight of 350 calculated as the acid form and an equivalent weight of about 50 to about 80, calculated as the acid form (e.g., polymers of itaconic acid acrylic acid maleic acid; aconitic acid; mesaconic acid; fumaric acid; methylene malonic acid; and citraconic acid and copolymers with themselves and other compatible monomers containing no carboxylate radicals such as ethylene, styrene and vinylmethyl ether). These polycarboxylate builder salts are more specifically described in U.S. Pat. No. 3,308,067 to Diehl issued Mar. 7, 1967; incorporated herein by reference.

The most preferred water conditioner for use in the most preferred embodiments of this invention are water soluble polymers of acrylic acid, acrylic acid copolymers; and derivatives and salts thereof. Such polymers include polyacrylic acid, polymethacrylic acid, acrylic acid-methacrylic acid copolymers, hydrolyzed polyacrylamide, hydrolyzed polymethacrylamide, hydrolyzed acrylamidemethacrylamide copolymers, hydrolyzed polyacrylonitrile, hydrolyzed polymethacrylonitrile, hydrolyzed acrylonitrilemethacrylonitrile copolymers, or mixtures thereof. Water soluble salts or partial salts of these polymers such as the respective alkali metal (e.g. sodium, lithium potassium) or ammonium and ammonium derivative salts can also be used. The weight average molecular weight of the polymers is from about 500 to about 15,000 and is preferably within the range of from 750 to 10,000. Preferred polymers include polyacrylic acid, the partial sodium salt of polyacrylic acid or sodium polyacrylate having weight average molecular weights within the range of 1,000 to 5,000 or 6,000. These polymers are commercially available, and methods for their preparation are well-known in the art.

For example, commercially available polyacrylate solutions usefull in the present cleaning compositions include the sodium polyacrylate solution, COLLOID® 207 (Colloids, Inc., Newark, N.J.); the polyacrylic acid solution, AQUATREAT® AR-602-A (Alco Chemical Corp., Chattanooga, Tenn.); the polyacrylic acid solutions (50–65% solids) and the sodium polyacrylate powders (M.W. 2,100 and 6,000) and solutions (45% solids) available as the GOODRITE® K-700 series from B. F. Goodrich Co.; and the sodium or partial sodium salts of polyacrylic acid solutions (M.W. 1000 to 4500) available as the ACUSOL® series from Rohm and Haas. Combinations and admixtures of any of the above enumerated water conditioning agents may be advantageously utilized within the embodiments of the present invention.

Any non-quaternary ammonium compound antimicrobial agent can be used in the compositions of the invention to incorporate bacteristatic, bactericidal or sanitizing action to the cleaners of the invention. The useful antimicrobial agent is physically and chemically compatible with the aqueous systems of the invention and will be stable under conditions of manufacture, use, storage, sale, dilution and application. Commonly available antimicrobials include phenolic antimicrobials such as pentachlorophenol, orthophenylphenol and other similar chlorinated aromatic hydrocarbons. Another useful type of halogen containing antimicrobial agents are the chlorinated isocyanates such as trichloroisocyanurates and salts thereof. Other useful agents include amine, alkanolamine and nitro containing antimicrobial agents, bisthiocyanates, dithiocarbamates, sulfones and imidazoline antimicrobials.

The following general formulation tables show preferred formulations for use in the invention.

TABLE 1

Concentrate Formulations

| RAW MATERIAL | PREFERRED |
|---|---|
| Soft Water | 35–99 wt % |
| Esther Sulfonate | 0.3–18 wt % |
| Aromatic Sulfonate | 0.15–15 wt % |
| Nonionic Low Foam Surfactant | 0.1–11 wt % |
| Solvent | 0.1–15 wt % |
| Sequestrant | 0.1–4 wt % |
| Antimicrobial | 0.01–2.5 wt % |

TABLE 2

Use Solution

| RAW MATERIAL | PREFERRED (ppm) | MOST PREFERRED (ppm) |
|---|---|---|
| Ester Sulfonate | 35–300 | 80–250 |
| Aromatic Sulfonate | 20–200 | 40–160 |
| Nonionic Low Foam Surfactant | 10–500 | 50–300 |
| Solvent | 5–500 | 10–400 |
| Sequestrant | 10–400 | 10–300 |
| Antimicrobial | 50–600 | 50–300 |

The formulations of the invention can also include other ingredients that can increase the properties, ease of use, or compatibility of the materials with the cleaning personnel. Such materials include dyes, perfumes, propellant gases, etc.

In an initial screening test, simple aqueous solutions of surfactant materials were screened for sheeting capacity. In initial screening tests, we found that a combination of an aromatic sulfonate such as an alkyl diphenyl oxide disulfonate, and a dialkylsulfosuccinate surfactant provided rapid sheeting of the final aqueous cleaner leaving a hard surface with no film. A test of these materials is shown in the following Table 3.

TABLE 3

| SURFACTANT | (ppm) | RINSING | TIME | APPEARANCE |
|---|---|---|---|---|
| Aromatic sulfonate/dialkyl sulfosuccinate | 375/200 | GOOD | 4 Min. | No Film |
| Aromatic sulfonate/dialkyl sulfosuccinate | 187/100 | GOOD | 4 Min. | No Film |
| Aromatic sulfonate/dialkyl | 100/100 | GOOD/OK | 8 Min. | No Film |

TABLE 3-continued

| SURFACTANT | (ppm) | RINSING | TIME | APPEARANCE |
|---|---|---|---|---|
| sulfosuccinate | | | | |
| Aromatic sulfonate/dialkyl sulfosuccinate | 133/66 | OK | 8 Min. | No Film |

The following formulations show preferred acidic, mildly alkaline and marble safe, generally neutral cleaning compositions. These general formulations can be used as a cleaner prior to the application of the finish cleaner composition of the invention.

ACID BATHROOM CLEANER

| RAW MATERIAL | TRADE NAME | WT % |
|---|---|---|
| Soft water | — | balance |
| Phosphoric acid (75%) | — | 23.3 |
| Citric acid (50%) | — | 9.8 |
| Diethylene glycol monobutyl ether | Butyl carbitol | 8.0 |
| Lauryl dimethyl amine oxide | Barlox 12 | 7.0 |
| Nonyl phenol ethoxylate 9–10 mole | NPE 9.5 | 4.0 |
| Nonyl phenol ethoxylate 4.5 mole | NPE 4.5 | 2.0 |
| TOTAL: | | 100.00 |

NON-ACID BATHROOM CLEANER

| RAW MATERIAL | WT % |
|---|---|
| Soft water | balance |
| Potassium hydroxide liquid, 45% | 11.2 |
| Acid EDTA powder | 4.9 |
| Alkyl polyethoxy phosphate ester (PE-362) | 7.5 |
| Isoctyl phenoxy 9–10 mole ethoxylate | 6.0 |
| Dipropylene glycol monomethyl ether | 12.0 |
| Nonyl phenol ethoxylate 4.5 mole | 3.5 |
| Dipropylene glycol n-propyl ether | 2.5 |
| Sodium xylene sulfonate, 40% | 5.0 |
| TOTAL: | 100.00 |

MARBLE SAFE CLEANER

| RAW MATERIAL | WT % |
|---|---|
| Deionized water | balance |
| N–propoxypropanol | 15.0 |
| Potassium hydroxide 45% | 5.9 |
| Linear dodecyl benzene sulfonic acid (96%) | 13.6 |
| Polyoxypropylene polyoxy ethylene block copolymer | 2.0 |
| Sodium bicarbonate | 1.0 |
| Potassium carbonate | 1.0 |
| Lauryl dimethyl amine oxide | 4.0 |
| Sodium xylene sulfonate, 40% | 7.5 |
| TOTAL: | 100.00 |

TABLE 4

Examples 1–6 of the Finish cleaner Product Dilutable Concentrate Compositions

| RAW MATERIAL | FUNCTION | WT % Ex. 1 | Ex. 2 | Ex. 3 | Ex. 4 | Ex. 5 | Ex. 6 |
|---|---|---|---|---|---|---|---|
| soft water | Diluent | 98.54 | 98.30 | 82.20 | 37.77 | 40.99 | 56.95 |
| dioctyl sulfosuccinate | Surfactant | 0.50 | 0.52 | 4.50 | 21.00 | 21.00 | 15.00 |
| di-sec-hexyl-diphenyloxide sulfonate | Surfactant | 0.51 | 0.52 | 4.50 | 21.44 | 21.44 | 15.30 |
| isopropyl alcohol | Co-solvent | | | 3.80 | | | |
| butyl cellosolve | Solubilizer/solvent | 0.20 | 0.55 | 5.00 | 10.00 | 6.78 | 5.75 |
| Ethoxylated alkenyl nonionic | Surfactant | 0.24 | | | 9.79 | 9.79 | 7.00 |
| Pluronic ® nonionic | Surfactant | | 0.1 | | | | |
| use concentration dilution | | 3–5:100 | 3–5:100 | 0.5:100 | 0.1:100 | 0.1:100 | 0.15:100 |

The finish cleaner compositions of the invention were tested for foam sheeting performance and dried appearance of the hard surface. In the foam reading, the preferred compositions generate either no foam or minimal foam which rapidly breaks to a rapidly draining sheet. The compositions were also rated for sheeting performance, i.e., to form an even wetted surface and the capacity to rapidly drain from the hard surface. Lastly, the compositions were tested for dried appearance. A high gloss, high shine appearance with no spotting, streaking or film formation is preferred. The following Table 5 shows the experiment run with Examples 1 through 5 of the finish cleaners of the invention and comparative Examples 1 through 16 of similar compositions that either had excessive foam, did not sheet or left a dull, spotted, streaked or filmed appearance.

TABLE 5

Room Temperature Sheeting and Rinse Performance Test
CONCENTRATION OF PRODUCT IN RINSE
SOLUTION-(300 ppm HARD WATER WITH 100 ppm NaCl)

| | EXAMPLES | | | | | COMP | | | | | |
|---|---|---|---|---|---|---|---|---|---|---|---|
| RAW MATERIALS | 1 | 2 | 3 | 4 | 5 | 1 | 2 | 3 | 4 | 5 | 6 |
| di-sec-hexyl-diphenyloxide sulfonate (45%) | 125 | 250 | 125 | 250 | 250 | 500 | | | | | 125 |
| dioctyl sulfosuccinate (75%) | 125 | 250 | 125 | 250 | 250 | | 500 | | | | 125 |
| SURFYNOL ® 504 | | 100 | | | | | | 500 | | | |
| PLURONIC ® 25R2 | | | 50 | 100 | 50 | | | | | | |
| LF-221 | | | | | | | | | 333 | 250 | |
| Propyl Capped (EO)(PO) nonionic | | | | | | | | | 166 | 500 | |
| SURFYNOL ® 104 | | | | | | | | | | | 125 |
| SURFYNOL ® 420 | | | | | | | | | | | |
| PLURONIC ® 31R1 nonionic | | | | | | | | | | | |
| silicone defoamer | | | | | | | | | | | |
| sodium xylene sulfonate | | | | | | | | | | 75 | |
| FOAM RATING | 3 | 4 | 3 | 2 | 3 | 2 | 5 | 5 | 3 | 5 | 4 |
| APPLICATION[1] | | | | | | | | | | | |
| SHEETING PERFORMANCE[2] | 5 | 5 | 4 | 5 | 5 | 1 | 3 | 5 | 3 | 4 | 3 |
| DRIED APPEARANCE[3] | 4 | 5 | 5 | 5 | 5 | 1 | 2 | 2 | 2 | 3 | 2 |

| | COMP | | | | | | | | | |
|---|---|---|---|---|---|---|---|---|---|---|
| RAW MATERIALS | 7 | 8 | 9 | 10 | 11 | 12 | 13 | 14 | 15 | 16 |
| di-sec-hexyl-diphenyloxide sulfonate (45%) | 125 | 125 | 175 | 125 | 250 | 250 | 125 | 95 | | |
| dioctyl sulfosuccinate (75%) | 125 | 125 | 100 | 125 | 250 | 250 | 125 | 95 | | |
| SURFYNOL ® 504 | | 50 | 100 | | | | | | | |
| PLURONIC ® 25R2 | | | | | | | | | | |
| LF-221 | | | | | | | | | | |
| Propyl Capped (EO)(PO) nonionic | | | | | | | | | | |
| SURFYNOL ® 104 | | | | | | | | | | |
| SURFYNOL ® 420 | 50 | | | | | | | | | |
| PLURONIC ® 31R1 nonionic | | | | 50 | 50 | | | | | |
| silicone defoamer | | | | | | 50 | 100 | 125 | | |
| sodium xylene sulfonate | | | | | | | | | 1000 | 500 |
| FOAM RATING | 4 | 4 | 4 | 4 | 4 | 4 | 5 | 3 | 5 | 5 |
| APPLICATION[1] | | | | | | | | | | |
| SHEETING PERFORMANCE[2] | 5 | 5 | 4 | 4 | 4 | 5 | 3 | 3 | 1 | 1 |
| DRIED APPEARANCE[3] | 4 | 4 | 5 | 3 | 4 | 4 | 3 | 1 | 1 | 1 |

[1]5 = No Foam/No Pin Holing 4 = No Foam/Low Amount of Pin Holing 3 = Low to Moderate Foam 2 = Sudsy 1 = High Foam
[2]5 = Excellent Sheeting - Uniform Margin During Drying 4 = Good Sheeting - Uneven Margins During Drying 3 = Unacceptable - Initially Sheets Then Breaks 2 = Not Used 1 = No Sheeting - Beads Up
[3]5 = High Gloss 4 = Shines/Very Slight Detectable Film 3 = Unacceptable - Noticeable Film Present 2 = Noticeable Streaking (Vein Appearance) 1 = Very Heavy Residuals Clearly, Examples 2–5 of the invention containing the aromatic sulfonate, the ester sulfonate surfactant and the antifoaming nonionic provided the best performing compositions of the invention. A final dried appearance of the hard surface is the most important criterion, however, foaming and sheeting are important aspects. These experiments were done with the following room temperature sheeting and rinse performance test protocol.

ROOM TEMPERATURE SHEETING AND RINSE PERFORMANCE TEST

This test is designed to evaluate products for sheeting and rinse characteristics at room temperature. This is to simulate use conditions in a shower, bath or locker room.

Materials

Glazed Black Tiled Test Panels
Gloss Black Bath Tile

Test Solution

Spray Apparatus:

2 liter pre-sizable hand sprayer such as garden sprayer portable electric pump-driven hand sprayer (Ecolab internal design)

Test Method

1. Test solution or components are diluted in 300 ppm hardness well water and 100 ppm NaCl to increase total dissolved solids.
2. Panel is sprayed with cleaning product such as Alkaline Bathroom Cleaner at 3 oz/gallon or Acid Bathroom Cleaner at 8 oz/gallon concentration.
3. Panel is agitated with sponge to provide maximum contact of cleaner.
4. Panels are rinsed with test solution to fully saturate and flood surface.
5. Panels are allowed to dry in upright position until fuilly dried.
6. Panels are visually evaluated for application foam amounts, sheeting while wet, and for visual acceptance after drying. A visual evaluation number is applied to each step.

VISUAL PERFORMANCE RATING SYSTEM

APPLICATION FOAM RATING:

5=No Foam/No Pin Holing

4=No Foam/Low Amount of Pin Holding

3=Low to Moderate Foam

2=Sudsy

1=High Foam

SHEETING PERFORMANCE RATING:

5=Excellent Sheeting—Uniform Margin During Drying

4=Good Sheeting—Uneven Margins During Drying

3=Unacceptable—Initially Sheets, then Breaks

2=Not Used

1=No Sheeting—Beads Up

DRIED APPEARANCE RATING:

5=High Gloss

4=Shines/Very Slight Detectable Film

3=Unacceptable—Noticeable Film Present

2=Noticeable Streaking (Vein Appearance)

1=Very Heavy Residuals

The above specification, examples and data provide a complete description of the manufacture and use of the composition of the invention. Since many embodiments of the invention can be made without departing from the spirit and scope of the invention, the invention resides in the claims hereinafter appended.

We claim:

1. An aqueous low-foam hard surface finish cleaner composition, that can be used to remove soil residue from a hard surface leaving a clean shiny surface, the cleaner comprising:

(a) 0.3 to 18 wt. % of an aromatic sulfonate of the formula:

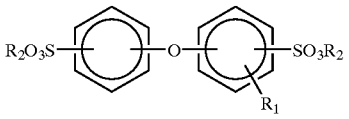

wherein $R_1$ is a $C_{1-12}$ aliphatic group, and $R_2$ is independently $H^+$, an alkali metal cation, $NH_4^+$, or a mono-, di- or tri-alkanol amine cation (b) an effective amount of a sulfonate ester of the formula:

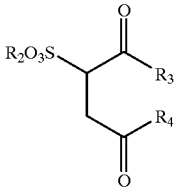

wherein each $OR_3$ or $OR_4$ is independently a $C_{6-14}$ aliphatic group, and $R_2$ is $H^+$, an alkali metal cation, $NH_4^+$, or a mono-, di- or trialkanol amine cation;

(c) about 0.11 to 11 wt. % of polyoxyethylene acetylene glycol surfactant; and (d) a major proportion of an aqueous diluent;

wherein after application of the hard surface cleaner, the hard surface dries to a clean, spot-, streak- and film-free appearance.

2. The composition of claim 1 wherein the cleaner composition additionally comprises an effective soil removing amount of a water soluble solvent.

3. The composition of claim 2 wherein the solvent comprises a solvent of the formula:

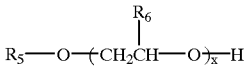

wherein x is an integer of about 1 to 6, $R_5$ is a $C_{1-12}$ aliphatic group and $R_6$ is H or $CH_3$.

4.The composition of claim 4 wherein the solvent comprises a mixture of a lower alkanol selected from the group consisting of methanol, ethanol, isopropanol, n-propanol and mixtures thereof and an aliphatic glycol monoalkylether wherein $R_5$ is an aliphatic group of 1 to 8 carbon atoms, the ratio between the lower alkanol and the aliphatic glycol monoalkylether being about 0.1 to 1 to about 2 to 1.

5. The composition of claim 1 wherein $R_1$ is selected from the group consisting of a $C_6$–$C_{10}$ aliphatic group.

6. The composition of claim 3, comprising about 0.15 to 15 wt % of the aromatic sulfonate; about 0.3 to 18 wt % of a sodium dialkyl sulfosuccinate wherein $R_3$ and $R_4$ are each independently a $C_{6-14}$ aliphatic group; about 0.1 to 11 wt % of an ethoxylated decyne diol; about 1 to 15 wt % of an aliphatic glycol monoalkylether wherein $R_5$ is an alkyl of 1–8 carbon atoms; about 0 to 10 wt % of a lower alkanol, and the balance being water.

7. The composition of claim 1 which also comprises an effective amount of a sequestrant.

8. The composition of claim 1 which also comprises an effective amount of an antimicrobial agent.

9. An aqueous low-foam use solution cleaning composition, that can be used to remove soil residue from a hard surface leaving a clean shiny surface, the cleaner comprising:

(a) about 20 to 200 ppm of and aromatic sulfonate surfactant of the formula:

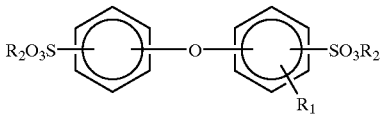

wherein R1 is a C1-12 aliphatic group, and R2 is independently H+, and alkali metal cation, NH4+, or a mono-, di, or tri-alkanol amine cation (b) 35 to 300 ppm of a sulfonate ester of the formula:

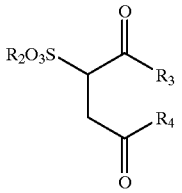

wherein $OR_3$ or $OR_4$ are each independently a $C_{6-14}$ aliphatic group, and $R_2$ is $H^+$, an alkali metal cation, $NH_4^+$, or a mono-, di- or triethanol amine cation;

(c) about 10 to 500 ppm of polyoxyethylene acetylene glycol surfactant; and (d) a major proportion of an aqueous diluent;

wherein after application of the hard surface cleaner, the hard surface dries to a clean, spot-, streak- and film-free appearance.

10. A process for cleaning a hard surface, the surface comprising metal, painted metal, glass, composite or ceramic, to remove soil, the process comprising the steps of:

(a) applying to the hard surface an aqueous cleaner composition producing a treated surface having a cleaner residue; and (b) applying to the treated surface having a cleaner residue, an aqueous finish cleaner composition, that can be used to remove soil from the treated surface, the cleaner comprising:

(i) an effective soil removing amount of an aromatic sulfonate surfactant; of the formula:

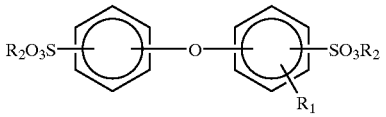

wherein R1 is a C1-12 aliphatic group, and R2 is independently H+, and alkali metal cation, NH4+, or a mono-, di-, or tri-alkanol amine cation (ii) an effective amount of a sulfonate ester of the formula:

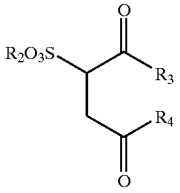

wherein $OR_3$ or $OR_4$ are each independently a $C_{6-14}$ aliphatic group, and $R_2$ is $H^+$, an alkali metal cation, $NH_4^+$, or a mono-, di- or trialkanolamine amine cation;

(iii) a nonionic polyoxyethylene acetylene glycol surfactant; and (iv) a major proportion of an aqueous diluent;

wherein after application of the hard surface finish cleaner, the process is substantially free of hand wiping and the hard surface dries to a clean, spot-free, streak-free and film-free appearance.

11. The process of claim 10 wherein there are about 20 to 200 parts by weight of an alkyl diphenyl oxide sulfonate surfactant for each one million parts of the aqueous hard surface cleaner.

12. The process of claim 10 wherein there are about 35 to 300 parts by weight of the sulfonate ester for each one million parts of the hard surface cleaner.

13. The process of claim 10 wherein the nonionic defoaming surfactant comprises an alkoxylated $C_{4-20}$ alkyn diol.

14. The process of claim 10 wherein the nonionic defoaming surfactant comprises a surfactant of the formula $(PO)_x(EO)_y(PO)_z$ wherein x ranges from about 5 to about 21, y ranges from about 4 to about 60 and z ranges from about 5 to about 21, or a surfactant of the formula

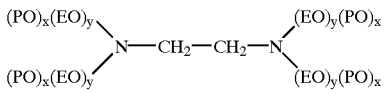

wherein x ranges from about 8 to about 30 and y ranges from about 1 to about 124, or a mixture thereof.

15. The process of claim 10 wherein the cleaner composition additionally comprises an effective soil removing amount of a water soluble solvent.

16. The process of claim 10 wherein the composition comprises about 0.15 to 15 wt % of the aromatic sulfonate surfactant; about 0.3 to 18 wt % of the sulfonate ester surfactant; about 0.1 to 11 wt % of the defoaming nonionic surfactant and about 0.1 to 15 wt % of a water soluble solvent.

17. The process of claim 16 wherein the solvent comprises a solvent of the formula

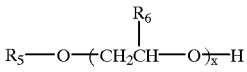

wherein x is an integer of about 1 to 6, $R_5$ is a $C_{1-8}$ aliphatic group and $R_6$ is H or $CH_3$.

18. The process of claim 17 wherein the solvent comprises a mixture of a lower alkanol selected from the group consisting of methanol, ethanol, isopropanol, n-propanol and mixtures thereof, and an aliphatic glycol monoalkylether wherein $R_5$ is an aliphatic group of 1 to 8 carbon atoms; the ratio between the lower alkanol and the aliphatic glycol monoalkylether is about 0.1 to 1 to about 2 to 1.

19. The process of claim 10 wherein the cleaner composition comprises about 0.15 to 15 wt % of the aromatic sulfonate; about 0.3 to 18 wt % of a dialkyl sulfosuccinate wherein $R_3$ and $R_4$ are each independently a $C_{6-12}$ alkyl group and $R_2$ is $H^+$, an alkali metal cation, $NH_4^+$, or a mono-, di- or triethanol amine cation; about 0.1 to 11 wt % of an ethoxylated decyne diol; about 0.1 to 15 wt % of an aliphatic glycol monoalkylether wherein the alkyl group is a $C_{1-6}$ alkyl group; about 0.5 to 10 wt % of a lower alkanol, and the balance being water.

* * * * *